US010612548B2

(12) United States Patent
Izumi et al.

(10) Patent No.: US 10,612,548 B2
(45) Date of Patent: Apr. 7, 2020

(54) REFRIGERANT PATH HOLES IN A ROTARY COMPRESSOR

(71) Applicant: FUJITSU GENERAL LIMITED, Kanagawa (JP)

(72) Inventors: Yasuyuki Izumi, Kanagawa (JP); Kenshi Ueda, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 305 days.

(21) Appl. No.: 15/812,822

(22) Filed: Nov. 14, 2017

(65) Prior Publication Data

US 2018/0135632 A1 May 17, 2018

(30) Foreign Application Priority Data

Nov. 17, 2016 (JP) ..... 2016-224217

(51) Int. Cl.

| | |
|---|---|
| ***F04C 18/356*** | (2006.01) |
| ***F04C 23/00*** | (2006.01) |
| ***F04C 29/06*** | (2006.01) |
| ***F04C 28/02*** | (2006.01) |
| ***F04C 29/12*** | (2006.01) |

(52) U.S. Cl.

CPC ..... *F04C 18/356* (2013.01); *F04C 23/001* (2013.01); *F04C 28/02* (2013.01); *F04C 29/06* (2013.01); *F04C 29/12* (2013.01); *F04C 2250/102* (2013.01)

(58) Field of Classification Search

CPC ..... F04C 18/356; F04C 2250/102; F04C 23/001; F04C 28/02; F04C 29/12; F04C 29/124

See application file for complete search history.

(56) References Cited

FOREIGN PATENT DOCUMENTS

| | | | |
|---|---|---|---|
| CN | 104454548 | A | 3/2015 |
| JP | 2010-048089 | A | 3/2010 |
| JP | 2012-167584 | A | 9/2012 |
| JP | 2014-145318 | A | 8/2014 |
| WO | 2013/065706 | A1 | 5/2013 |
| WO | 2016/114016 | A1 | 7/2016 |

OTHER PUBLICATIONS

Extended European Search Report issued in Application No. 17202014.1 dated Apr. 5, 2018.

*Primary Examiner* — Mary Davis

(74) *Attorney, Agent, or Firm* — McDermott Will & Emery LLP

(57) ABSTRACT

In a rotary compressor, S1>S3, S2>S3, and S2'>S3' are satisfied when a sectional area of a refrigerant path hole on a lower endplate is S1, a sectional area of the refrigerant path hole in a lower cylinder is S2, a sectional area of the refrigerant path hole on an intermediate partition plate is S3, an area in which a section of the refrigerant path hole on the lower end plate and a section of the refrigerant path hole in the lower cylinder overlap each other is S2', and an area in which a section of the refrigerant path hole in the lower cylinder and a section of the refrigerant path hole on the intermediate partition plate overlap each other is S3'.

8 Claims, 8 Drawing Sheets

REFRIGERANT PATH HOLES IN A ROTARY COMPRESSOR

CROSS-REFERENCE

This application is based upon and claims the benefit of priority of the prior Japanese Patent Application No. 2016-224217, filed on Nov. 17, 2016, the entire contents of which are incorporated herein by reference.

FIELD

The invention relates to a rotary compressor.

BACKGROUND ART

For example, in Japanese Laid-on Patent Publication No. 2014-145318, in a two-cylinder type rotary compressor, a technique is described in which heating of an intake refrigerant on an inlet chamber side of a lower cylinder and an upper cylinder by a compressed refrigerant is suppressed by disposing a refrigerant path hole in which a high-temperature compressed refrigerant compressed by the lower cylinder and discharged from a lower discharge hole flows from a lower end plate cover chamber (lower muffler chamber) to an upper end plate cover chamber (upper muffler chamber) in a position away from the inlet chamber side of the lower cylinder and the upper cylinder, and thus compression efficiency is improved.

In addition, in International Laid-on Patent Publication WO 2013/094114, a technology which suppresses that a high-temperature compressed refrigerant which is compressed in a lower cylinder and is discharged from a lower discharge hole heats a lower end plate and heats an intake refrigerant in an inlet chamber of the lower cylinder, and a compressor efficiency is improved, is described.

In the rotary compressor described in Japanese Laid-on Patent Publication No. 2014-145318, the refrigerant path hole is positioned in the vicinity of a lower vane and an upper vane which divide each of the lower cylinder and the upper cylinder into the inlet chamber and the compression chamber, and thus, the size of the diameter is restricted. Therefore, since the refrigerant that flows through the refrigerant path hole receives a resistance of the flow channel, there is a problem that the compression efficiency of the rotary compressor deteriorates. Furthermore, the refrigerant that flows through the refrigerant path hole receives the resistance of the flow channel, and accordingly, there is also a problem that quietness of the rotary compressor deteriorates.

In addition, when the rotary compressor described in Japanese Laid-on Patent Publication No. 2014-145318 performs the injection for injecting a liquid refrigerant (injection liquid) to the compression chamber during the compression for improving the compression efficiency of the refrigerant in a refrigeration cycle, the amount of the refrigerant which flows into an upper muffler chamber via the refrigerant path hole from a lower muffler chamber increases, the flow of the refrigerant changes, and thus, resonance in the muffler chamber increases, and the quietness deteriorates.

SUMMARY

An object of the invention is to reduce a flow channel resistance of the refrigerant that flows through the refrigerant path hole, and to prevent deterioration of compression efficiency of a rotary compressor.

According to the invention, there is provided a rotary compressor which includes a sealed vertically-placed cylindrical compressor housing which is provided with a discharge pipe that discharges a refrigerant in an upper portion thereof, and which is provided with an upper inlet pipe and a lower inlet pipe that suction the refrigerant in a lower portion of a side surface thereof, an accumulator which is fixed to a side portion of the compressor housing and is connected to the upper inlet pipe and the lower inlet pipe, a motor which is disposed in the compressor housing, and a compressing unit which is disposed below the motor in the compressor housing, is driven by the motor, suctions and compresses the refrigerant from the accumulator via the upper inlet pipe and the lower inlet pipe, and discharges the refrigerant from the discharge pipe, and in which the compressing unit includes an annular upper cylinder and an annular lower cylinder, an upper end plate which blocks an upper side of the upper cylinder and a lower end plate which blocks a lower side of the lower cylinder, an intermediate partition plate which is disposed between the upper cylinder and the lower cylinder and blocks the lower side of the upper cylinder and the upper side of the lower cylinder, a rotation shaft which is supported by a main bearing unit provided on the upper end plate and a sub-bearing unit provided on the lower end plate, and is rotated by the motor, an upper eccentric portion and a lower eccentric portion which are provided with a phase difference from each other in a rotation shaft, an upper piston which is fitted to the upper eccentric portion, revolves along an inner circumferential surface of the upper cylinder, and forms an upper cylinder chamber in the upper cylinder, a lower piston which is fitted to the lower eccentric portion, revolves along an inner circumferential surface of the lower cylinder, and forms a lower cylinder chamber in the lower cylinder, an upper vane which protrudes from an upper vane groove provided in the upper cylinder in the upper cylinder chamber, abuts against the upper piston, and divides the upper cylinder chamber into an upper inlet chamber and an upper compression chamber, a lower vane which protrudes from a lower vane groove provided in the lower cylinder in the lower cylinder chamber, abuts against the lower piston, and divides the lower cylinder chamber into a lower inlet chamber and a lower compression chamber, an upper end plate cover which covers the upper end plate, forms an upper end plate cover chamber between the upper end plate and the upper end plate cover, and has an upper end plate cover discharge hole that allows the upper end plate cover chamber and the inside of the compressor housing to communicate with each other, a lower end plate cover which covers the lower end plate and forms a lower end plate cover chamber between the lower end plate and the lower end plate cover, an upper discharge hole which is provided on the upper end plate and allows the upper compression chamber and an upper end plate cover chamber to communicate with each other, a lower discharge hole which is provided on the lower end plate and allows the lower compression chamber and a lower end plate cover chamber to communicate with each other, and a refrigerant path hole which penetrates the lower end plate, the lower cylinder, the intermediate partition plate, the upper cylinder, and the upper end plate, and communicates with the lower end plate cover chamber and the upper end plate cover chamber, the compressor including: an upper discharge valve which opens and closes the upper discharge hole; a lower discharge valve which opens and closes the lower discharge hole; an upper discharge valve accommodation concave portion which is provided on the upper end plate and extends in a shape of a groove from a position of the upper discharge hole; and a lower discharge valve accommodation concave portion which is provided on the lower end plate and extends in a shape of a groove from a position of the lower discharge hole, in which the lower end plate cover is formed in a shape of a flat plate, in which a lower discharge chamber concave portion is formed on the lower end plate to overlap the lower discharge hole side of the lower discharge valve accommodation concave portion, in which the lower end plate cover chamber is configured of the lower discharge chamber concave portion and the lower discharge valve accommodation concave portion, in which the lower discharge chamber concave portion is formed within a fan-shaped range between straight lines that link the center of a first insertion hole and the center of a second insertion hole which are adjacent to each other among a plurality of insertion holes into which a fastening member that fastens the lower end plate cover, the lower end plate, the lower cylinder, the intermediate partition plate, the upper cylinder, the upper end plate, and the upper end plate cover is inserted and which are provided on a circumference of a concentric circle around the rotation shaft to penetrate the lower end plate, the lower cylinder, the intermediate partition plate, the upper cylinder, and the upper end plate, and the center of the sub-shaft unit, in which the refrigerant path hole communicates with the lower discharge chamber concave portion while at least apart thereof overlaps the lower discharge chamber concave portion, and is positioned between the lower vane groove and the first insertion hole in the lower cylinder, and between the upper vane groove and the first insertion hole in the upper cylinder, and in which S1>S3, S2>S3, and S2'>S3' are satisfied while a sectional area of the refrigerant path hole on the lower end plate is S1, a sectional area of the refrigerant path hole in the lower cylinder is S2, a sectional area of the refrigerant path hole on the intermediate partition plate is S3, an area in which a section of the refrigerant path hole on the lower end plate and a section of the refrigerant path hole in the lower cylinder overlap each other is S2', and an area in which a section of the refrigerant path hole in the lower cylinder and a section of the refrigerant path hole on the intermediate partition plate overlap each other is S3'.

According to the invention, it is possible to reduce a flow channel resistance of the refrigerant that flows through the refrigerant path hole, and to prevent deterioration of compression efficiency of a rotary compressor.

DETAILED DESCRIPTION OF THE INVENTION

Hereinafter, the invention will be described in detail with reference to the drawings based on an aspect (example) for realizing the invention. The example and each modification example which will be described hereinafter may be realized by appropriately combining the examples within a range without any contradiction.

EXAMPLE 1

Hereinafter, Example 1 according to the invention will be described.

Figure 1:
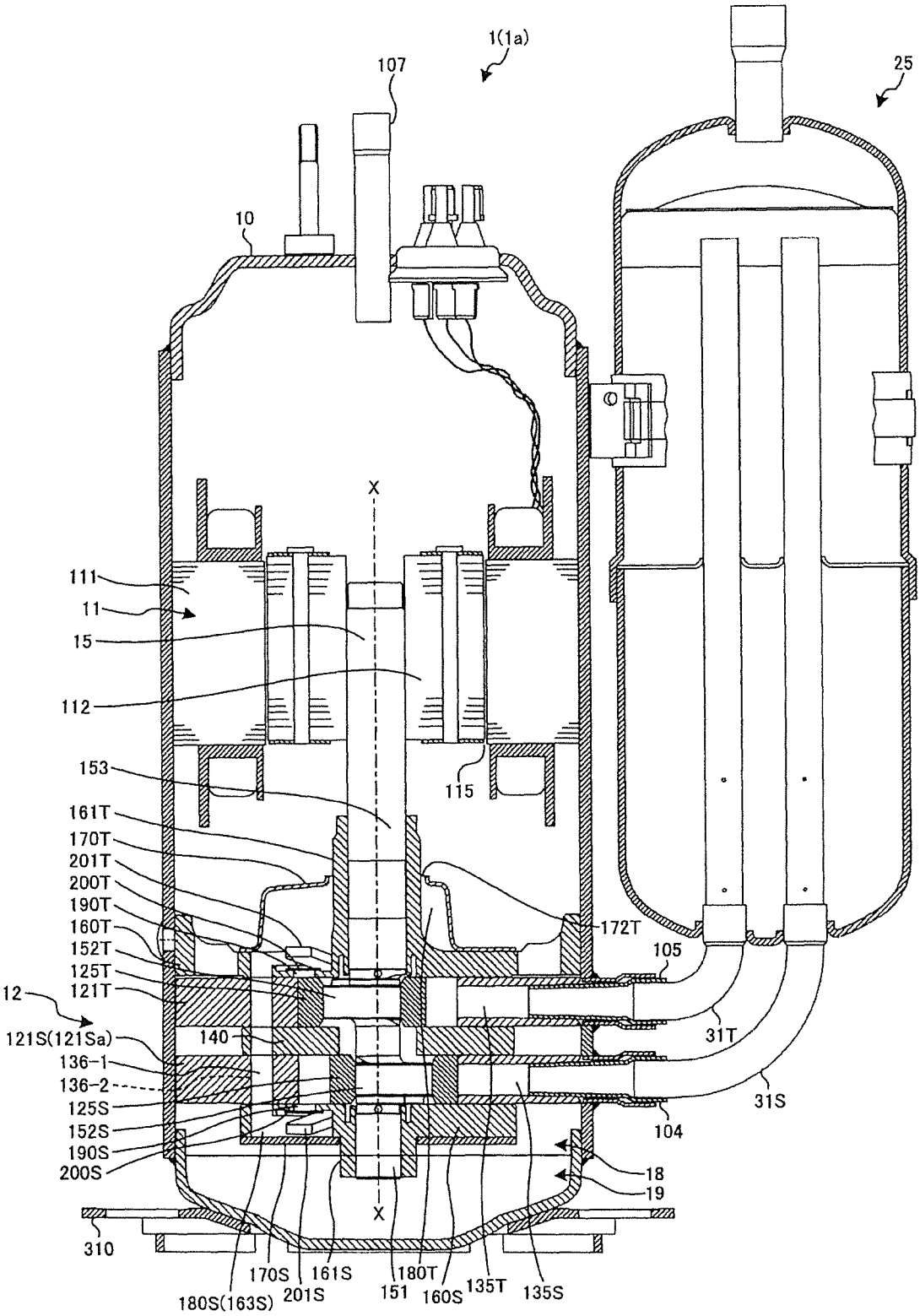
FIG. 1 is a longitudinal sectional view illustrating Example 1 of a rotary compressor according to the invention.
Figure 2:
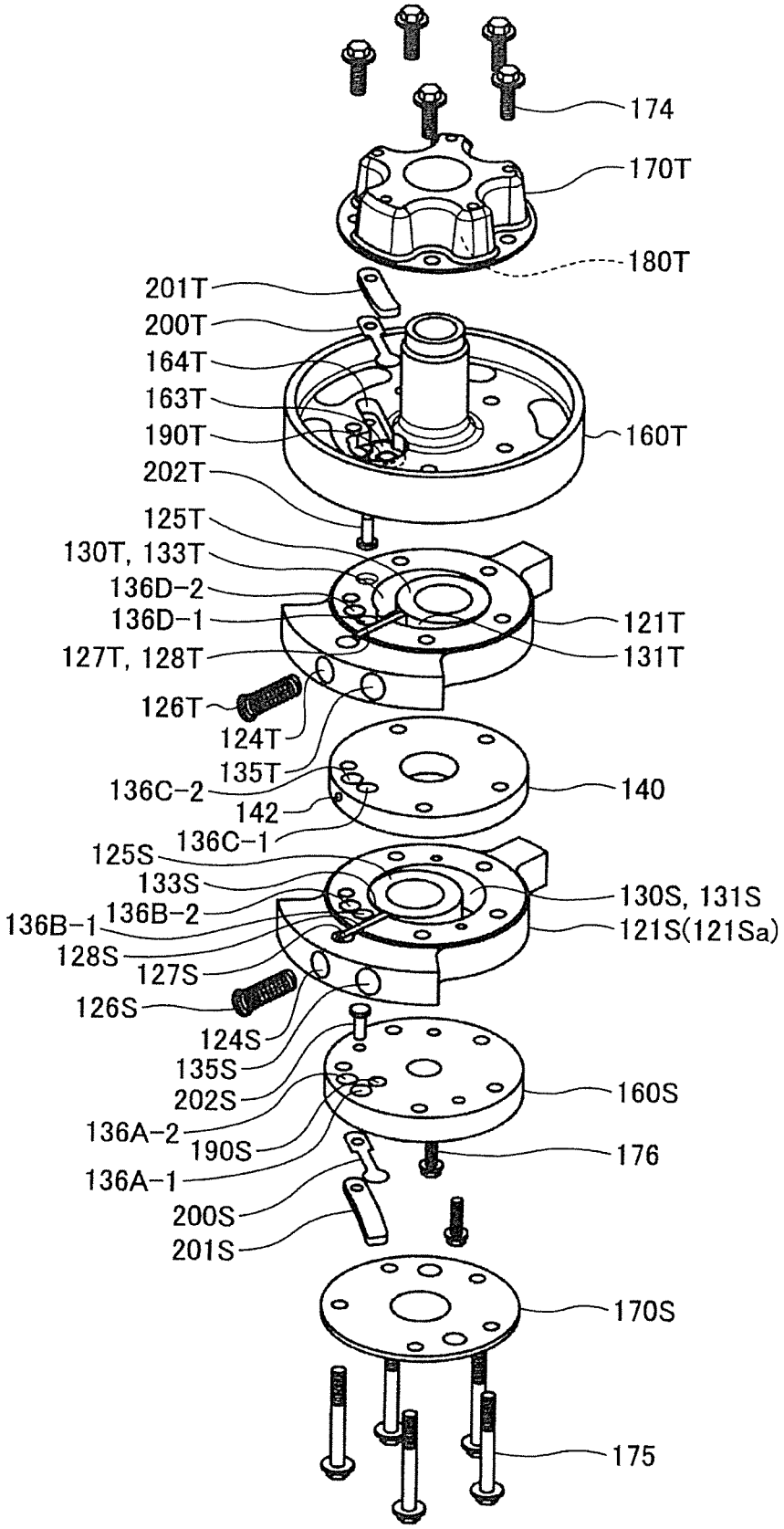
FIG. 2 is an upward exploded perspective view illustrating a compressing unit of the rotary compressor of Example 1.
Figure 3:
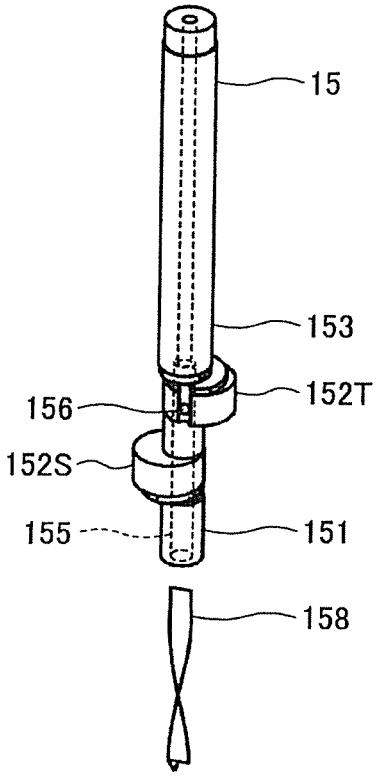
FIG. 3 is an upward exploded perspective view illustrating a rotation shaft and an oil feeding impeller of the rotary compressor of Example 1.

FIG. 1 is a longitudinal sectional view illustrating an example of a rotary compressor according to the invention, FIG. 2 is an upward exploded perspective view illustrating a compressing unit of the rotary compressor of the example, and FIG. 3 is an upward exploded perspective view illustrating a rotation shaft and an oil feeding impeller of the rotary compressor of the example.

As illustrated in FIG. 1, a rotary compressor 1 includes a compressing unit 12 which is disposed at a lower portion in a sealed vertically-placed cylindrical compressor housing 10, a motor 11 which is disposed above the compressing unit 12 and drives the compressing unit 12 via a rotation shaft 15, and a vertically-placed cylindrical accumulator 25 which is fixed to a side portion of the compressor housing 10.

The accumulator 25 is connected to an upper inlet chamber 131T (refer to FIG. 2) of an upper cylinder 121T via an upper inlet pipe 105 and an accumulator upper curved pipe 31T, and is connected to a lower inlet chamber 131S (refer to FIG. 2) of a lower cylinder 121S via a lower inlet pipe 104 and an accumulator lower curved pipe 31S.

The motor 11 includes a stator 111 on an outer side, and a rotor 112 on an inner side, the stator 111 is fixed by shrink fit to an inner circumferential surface of the compressor housing 10, and the rotor 112 is fixed by thermal fitting to the rotation shaft 15.

In the rotation shaft 15, a sub-shaft unit 151 at a lower part of a lower eccentric portion 152S is supported to be fitted to a sub-bearing unit 161S provided on a lower end plate 160S to be freely rotatable, a main shaft unit 153 at an upper part of an upper eccentric portion 152T is supported to be fitted to a main bearing unit 161T provided on an upper end plate 160T to be freely rotatable, each of the upper eccentric portion 152T and the lower eccentric portion 152S which are provided with a phase difference from each other by 180° is fitted to the upper piston 125T and the lower piston 125S to be freely rotatable, and accordingly, the rotation shaft 15 is supported by the entire compressing unit 12 to be freely rotatable, and each of the upper piston 125T and the lower piston 125S is allowed to perform an orbital motion along the inner circumferential surface of the upper cylinder 121T and the lower cylinder 121S by the rotation. Here, the rotation center at which the rotation shaft 15 is supported by the main bearing unit 161T and the sub-bearing unit 161S and rotates, is an X-X shaft.

On the inside of the compressor housing 10, in order to lubricate a sliding portion of the compressing unit 12 and to seal an upper compression chamber 133T (refer to FIG. 2) and a lower compression chamber 133S (refer to FIG. 2), a lubricant oil 18 is sealed only by an amount by which the compressing unit 12 is substantially immersed. On a lower side of the compressor housing 10, an attachment leg 310 which locks a plurality of elastic supporting members (not illustrated) that support the entire rotary compressor 1 is fixed.

As illustrated in FIG. 2, the compressing unit 12 is configured to laminate an upper end plate cover 170T which has a dome-shaped bulging portion, the upper end plate 160T, the upper cylinder 121T, an intermediate partition plate 140, the lower cylinder 121S, the lower end plate 160S, and a plate-shaped lower end plate cover 170S from above. The entire compressing unit 12 is fixed as each of a plurality of penetrating bolts 174 and 175 and an auxiliary bolt 176 which are vertically disposed substantially on a concentric circle is inserted into a plurality of bolt holes (a lower end plate first bolt hole 137A-1, a lower cylinder first bolt hole 137B-1, an intermediate partition plate first bolt hole 137C-1, an upper cylinder first bolt hole 137D-1, an upper end plate first bolt hole 137E-1, a lower end plate second bolt hole 137A-2, a lower cylinder second bolt hole 137B-2, an intermediate partition plate second bolt hole 137C-2, an upper cylinder second bolt hole 137D-2, an upper end plate second bolt hole 137E-2, a lower end plate third bolt hole 137A-3, a lower cylinder third bolt hole 137B-3, an intermediate partition plate third bolt hole 137C-3, an upper cylinder third bolt hole 137D-3, an upper end plate third bolt hole 137E-3, a lower end plate fourth bolt hole 137A-4, a lower cylinder fourth bolt hole 137B-4, an intermediate partition plate fourth bolt hole 137C-4, an upper cylinder fourth bolt hole 137D-4, an upper end plate fourth bolt hole 137E-4, a lower end plate fifth bolt hole 137A-5, a lower cylinder fifth bolt hole 137B-5, an intermediate partition plate fifth bolt hole 137C-5, an upper cylinder fifth bolt hole 137D-5, and an upper end plate fifth bolt hole 137E-5 (refer to FIGS. 4 to 8 which will be described later), also referred to as an insertion hole) which are provided on the circumference of the concentric circle around the rotation shaft 15. In addition, in the example, a case where the number of bolt holes which correspond to the penetrating bolts 174 and 175 is five, is described as an example, but the invention is not limited thereto. In addition, in the example, a case where the number of the auxiliary bolts 176 and the number bolt holes which correspond to the auxiliary bolts 176 are each two, is described as an example, but the invention is not limited thereto.

In the annular upper cylinder 121T, an upper inlet hole 135T which is fitted to the upper inlet pipe 105 is provided. In the annular lower cylinder 121S, a lower inlet hole 135S which is fitted to the lower inlet pipe 104 is provided. In addition, in an upper cylinder chamber 130T of the upper cylinder 121T, the upper piston 125T is disposed. In a lower cylinder chamber 130S of the lower cylinder 121S, the lower piston 125S is disposed.

In the upper cylinder 121T, an upper vane groove 128T which extends outward in a radial shape from the center of the upper cylinder chamber 130T is provided, and in the upper vane groove 128T, an upper vane 127T is disposed. In the lower cylinder 121S, a lower vane groove 128S which extends outward in a radial shape from the center of the lower cylinder chamber 130S is provided, and in the lower vane groove 128S, a lower vane 127S is disposed.

In the upper cylinder 121T, an upper spring hole 124T is provided at a depth that does not penetrate the upper cylinder chamber 130T at a position which overlaps the upper vane groove 128T from the outside surface, and an upper spring 126T is disposed in the upper spring hole 124T. In the lower cylinder 121S, a lower spring hole 124S is provided at a depth that does not penetrate the lower cylinder chamber 130S at a position which overlaps the lower vane groove 128S from the outside surface, and a lower spring 126S is disposed in the lower spring hole 124S.

Upper and lower parts of the upper cylinder chamber 130T are respectively blocked by the upper end plate 160T and the intermediate partition plate 140. Upper and lower parts of the lower cylinder chamber 130S are respectively blocked by the intermediate partition plate 140 and the lower end plate 160S.

The upper cylinder chamber 130T is divided into the upper inlet chamber 131T which communicates with the upper inlet hole 135T, and the upper compression chamber 133T which communicates with an upper discharge hole 190T provided on the upper end plate 160T, as the upper vane 127T is pressed to the upper spring 126T and abuts against the outer circumferential surface of the upper piston 125T. The lower cylinder chamber 130S is divided into the lower inlet chamber 131S which communicates with the lower inlet hole 135S and the lower compression chamber 133S which communicates with a lower discharge hole 190S provided on the lower end plate 160S, as the lower vane 127S is pressed to the lower spring 126S and abuts against the outer circumferential surface of the lower piston 125S.

In the upper end plate 160T, the upper discharge hole 190T which penetrates the upper end plate 160T and communicates with the upper compression chamber 133T of the upper cylinder 121T is provided, and on an exit side of the upper discharge hole 190T, an annular upper valve seat (not illustrated) which surrounds the upper discharge hole 190T is formed. On the upper end plate 160T, an upper discharge valve accommodation concave portion 164T which extends in a shape of a groove toward an outer circumference of the upper end plate 160T from the position of the upper discharge hole 190T, is formed.

In the upper discharge valve accommodation concave portion 164T, all of a reed valve type upper discharge valve 200T in which a rear end portion is fixed by an upper rivet 202T in the upper discharge valve accommodation concave portion 164T and a front portion opens and closes the upper discharge hole 190T, and an upper discharge valve cap 201T in which a rear end portion overlaps the upper discharge valve 200T and is fixed by the upper rivet 202T in the upper discharge valve accommodation concave portion 164T, and the front portion is curved (arched) in a direction in which the upper discharge valve 200T is open, and regulates an opening degree of the upper discharge valve 200T, are accommodated.

On the lower end plate 160S, the lower discharge hole 190S which penetrates the lower end plate 160S and communicates with the lower compression chamber 133S of the lower cylinder 121S is provided, and on the exit side of the lower discharge hole 190S, an annular lower valve seat 191S (refer to FIG. 4) which surrounds the lower discharge hole 190S is formed. On the lower end plate 160S, the lower discharge valve accommodation concave portion 164S (refer to FIG. 4) which extends in a shape of a groove toward the outer circumference of the lower end plate 160S from the position of the lower discharge hole 190S is formed.

In the lower discharge valve accommodation concave portion 164S, all of a reed valve type lower discharge valve 200S in which a rear end portion is fixed by a lower rivet 202S in the lower discharge valve accommodation concave portion 164S and a front portion opens and closes the lower discharge hole 190S, and a lower discharge valve cap 201S in which a rear end portion overlaps the lower discharge valve 200S and is fixed by the lower rivet 202S in the lower discharge valve accommodation concave portion 164S, and the front portion is curved (arched) in a direction in which the lower discharge valve 200S is open, and regulates an opening degree of the lower discharge valve 200S, are accommodated.

Between the upper end plates 160T which tightly adhere to each other and the upper end plate cover 170T which includes the dome-shaped bulging portion, an upper end plate cover chamber 180T is formed. Between the lower end plates 160S which tightly adhere to each other and the plate-shaped lower end plate cover 170S, a lower end plate cover chamber 180S is formed. As a circular hole which forms a first refrigerant path hole 136-1 which penetrates the lower end plate 160S, the lower cylinder 121S, the intermediate partition plate 140, the upper cylinder 121T, and the upper end plate 160T and communicates the lower end plate cover chamber 180S and the upper endplate cover chamber 180T, a lower end plate first circular hole 136A-1 is provided on the lower end plate 160S, a lower cylinder first circular hole 136B-1 is provided in the lower cylinder 121S, an intermediate partition plate first circular hole 136C-1 is provided on the intermediate partition plate 140, an upper cylinder first circular hole 136D-1 is provided in the upper cylinder 121T, and an upper end plate first circular hole 136E-1 is provided on the upper end plate 160T, respectively (refer to FIGS. 4 to 8). In addition, as a circular hole which forms a second refrigerant path hole 136-2 which penetrates the lower end plate 160S, the lower cylinder 121S, the intermediate partition plate 140, the upper cylinder 121T, and the upper endplate 160T, and communicates with the lower endplate cover chamber 180S and the upper end plate cover chamber 180T to be parallel to and independent from the first refrigerant path hole 136-1, a lower end plate second circular hole 136A-2 is provided on the lower end plate 160S, a lower cylinder second circular hole 136B-2 is provided in the lower cylinder 121S, an intermediate partition plate second circular hole 136C-2 is provided on the intermediate partition plate 140, an upper cylinder second circular hole 136D-2 is provided on the upper cylinder 121T, and an upper end plate second circular hole 136E-2 is provided on the upper end plate 160T, respectively (refer to FIGS. 4 to 8).

Hereinafter, in a case where the first refrigerant path hole 136-1 and the second refrigerant path hole 136-2 are integrally called, the holes are called a refrigerant path hole 136.

As illustrated in FIG. 3, in the rotation shaft 15, an oil feeding vertical hole 155 which penetrates from a lower end to an upper end is provided, and an oil feeding impeller 158 is pressurized to the oil feeding vertical hole 155. In addition, on the side surface of the rotation shaft 15, a plurality of oil feeding horizontal holes 156 which communicate with the oil feeding vertical hole 155 are provided.

Hereinafter, a flow of the refrigerant caused by the rotation of the rotation shaft 15 will be described. In the upper cylinder chamber 130T, by the rotation of the rotation shaft 15, as the upper piston 125T fitted to the upper eccentric portion 152T of the rotation shaft 15 revolves along the inner circumferential surface of the upper cylinder 121T, the refrigerant is suctioned from the upper inlet pipe 105 while the capacity of the upper inlet chamber 131T expands, the refrigerant is compressed while the capacity of the upper compression chamber 133T is reduced, and the pressure of the compressed refrigerant becomes higher than the pressure of the upper end plate cover chamber 180T on the outer side of the upper discharge valve 200T, and then, the upper discharge valve 200T is open and the refrigerant is discharged to the upper end plate cover chamber 180T from the upper compression chamber 133T. The refrigerant discharged to the upper end plate cover chamber 180T is discharged to the inside of the compressor housing 10 from an upper end plate cover discharge hole 172T (refer to FIG. 1) provided in the upper end plate cover 170T.

In addition, in the lower cylinder chamber 130S, by the rotation of the rotation shaft 15, as the lower piston 125S fitted to the lower eccentric portion 152S of the rotation shaft 15 revolves along the inner circumferential surface of the lower cylinder 121S, the refrigerant is suctioned from the lower inlet pipe 104 while the capacity of the lower inlet chamber 131S expands, the refrigerant is compressed while the capacity of the lower compression chamber 133S is reduced, and the pressure of the compressed refrigerant becomes higher than the pressure of the lower end plate cover chamber 180S on the outer side of the lower discharge valve 200S, and then, the lower discharge valve 200S is open and the refrigerant is discharged to the lower end plate cover chamber 180S from the lower compression chamber 133S. The refrigerant discharged to the lower end plate cover chamber 180S is discharged to the inside of the compressor housing 10 from the upper end plate cover discharge hole 172T (refer to FIG. 1) provided in the upper end plate cover 170T through the first refrigerant path hole 136-1, the second refrigerant path hole 136-2, and the upper end plate cover chamber 180T.

The refrigerant discharged to the inside of the compressor housing 10 is guided to the upper part of the motor 11 through a cutout (not illustrated) which is provided at an outer circumference of the stator 111 and vertically communicates, a void (not illustrated) of a winding unit of the stator 111, or a void 115 (refer to FIG. 1) between the stator 111 and the rotor 112, and is discharged from a discharge pipe 107 in the upper portion of the compressor housing 10.

Hereinafter, a flow of the lubricant oil 18 will be described. The lubricant oil 18 passes through the oil feeding vertical hole 155 and the plurality of oil feeding horizontal holes 156 from the lower end of the rotation shaft 15, supplies oil to a sliding surface between the sub-bearing unit 161S and the sub-shaft unit 151 of the rotation shaft 15, a sliding surface between the main bearing unit 161T and the main shaft unit 153 of the rotation shaft 15, a sliding surface between the lower eccentric portion 152S of the rotation shaft 15 and the lower piston 125S, and a sliding surface between the upper eccentric portion 152T and the upper piston 125T, and lubricates each of the sliding surfaces.

In a case where the lubricant oil 18 is suctioned up by giving a centrifugal force to the lubricant oil 18 in the oil feeding vertical hole 155, the lubricant oil 18 is discharged together with the refrigerant from the inside of the compressor housing 10, and an oil level is lowered, the oil feeding impeller 158 reliably plays a role of supplying the lubricant oil 18 on the sliding surfaces.

Figure 4:
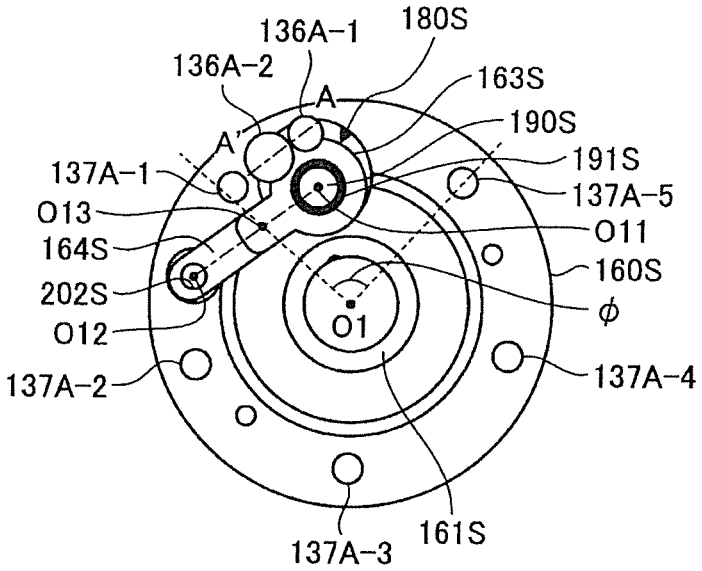
FIG. 4 is a bottom view illustrating a lower end plate of the rotary compressor of Example 1.
Figure 5:
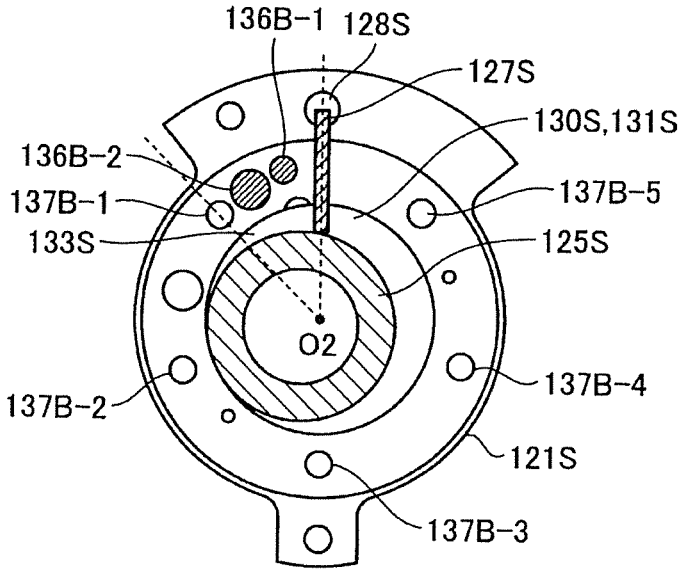
FIG. 5 is a bottom view illustrating a lower cylinder of the rotary compressor of Example 1.
Figure 6:
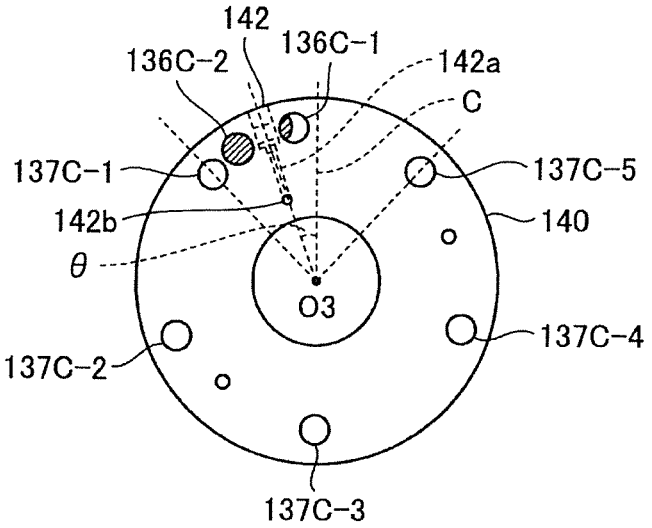
FIG. 6 is a bottom view illustrating an intermediate partition plate of the rotary compressor of Example 1.
Figure 7:
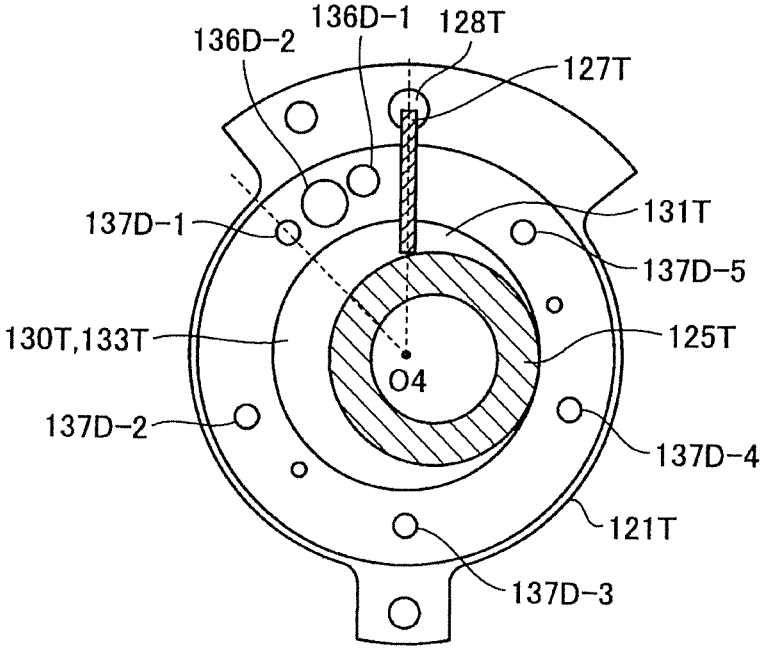
FIG. 7 is a bottom view illustrating an upper cylinder of the rotary compressor of Example 1.
Figure 8:
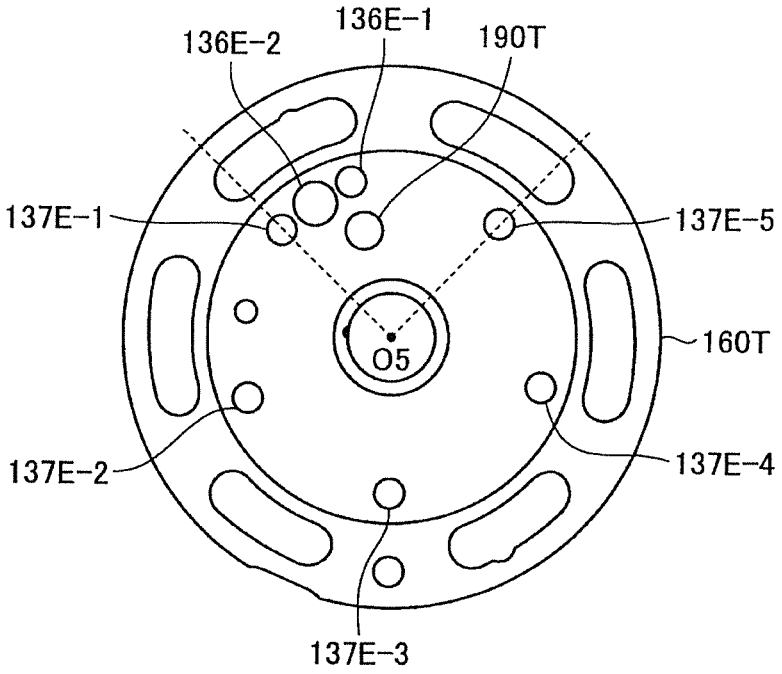
FIG. 8 is a bottom view illustrating an upper end plate of the rotary compressor of Example 1.

Next, a characteristic configuration of the rotary compressor 1 of the example will be described. FIG. 4 is a bottom view illustrating a lower end plate of the rotary compressor of the example. FIG. 5 is a bottom view illustrating a lower cylinder of the rotary compressor of Example 1. FIG. 6 is a bottom view illustrating an intermediate partition plate of the rotary compressor of Example 1. FIG. 7 is a bottom view illustrating an upper cylinder of the rotary compressor of Example 1. FIG. 8 is a bottom view illustrating an upper end plate of the rotary compressor of Example 1.

As illustrated in FIG. 4, since the lower end plate cover 170S has a shape of a plate and does not include the dome-shaped bulging portion similar to the upper end plate cover 170T, the lower end plate cover chamber 180S is configured of a lower discharge chamber concave portion 163S and the lower discharge valve accommodation concave portion 164S which are provided on the lower end plate 160S. The lower discharge valve accommodation concave portion 164S extends in a direction intersecting with a diametrical line that links the center of the sub-bearing unit 161S and the center of the lower discharge hole 190S, that is, linearly in a shape of a groove in a circumferential direction of the lower end plate 160S, from the position of the lower discharge hole 190S. The lower discharge valve accommodation concave portion 164S is connected to the lower discharge chamber concave portion 163S. The lower discharge valve accommodation concave portion 164S is formed such that the width thereof is slightly greater than the widths of the lower discharge valve 200S and the lower discharge valve cap 201S, accommodates the lower discharge valve 200S and the lower discharge valve cap 201S therein, and positions the lower discharge valve 200S and the lower discharge valve cap 201S.

The lower discharge chamber concave portion 163S is formed at the depth which is the same as the depth of the lower discharge valve accommodation concave portion 164S to overlap the lower discharge hole 190S side of the lower discharge valve accommodation concave portion 164S. The lower discharge hole 190S side of the lower discharge valve accommodation concave portion 164S is accommodated in the lower discharge chamber concave portion 163S.

The lower discharge chamber concave portion 163S is formed in a first fan-shaped range on a plane of the lower end plate 160S which is divided by a straight line that links a center O1 of the lower end plate 160S through which the X-X shaft passes and the lower end plate first bolt hole 137A-1, and a straight line that links the center O1 and the lower end plate fifth bolt hole 137A-5. For example, the lower discharge chamber concave portion 163S is formed within a fan-shaped range between a straight line that links the center O1 and a center O13 of a straight line L that links a center O11 of the lower discharge hole 190S and a center O12 of the lower rivet 202S, and a straight line which is open with a pitch angle $\phi=90°$ toward the lower discharge hole 190S around the center O1. In addition, the first fan shape may be a region on a plane of the lower end plate 160S which is divided by the straight line that links the center O1 of the lower end plate 160S through which the X-X shaft passes and the center of the lower end plate first bolt hole 137A-1 and the straight line that links the center O1 and the center of the lower end plate fifth bolt hole 137A-5.

On the lower end plate 160S, the lower end plate first circular hole 136A-1 is provided within the first fan-shaped range, that is, at a position at which at least a part thereof overlaps the lower discharge chamber concave portion 163S and communicates with the lower discharge chamber concave portion 163S. The lower end plate second circular hole 136A-2 is provided within the first fan-shaped range, that is, at a position at which at least a part thereof overlaps the lower discharge chamber concave portion 163S, communicates with the lower discharge chamber concave portion 163S, and is adjacent to the lower end plate first circular hole 136A-1. The lower end plate first circular hole 136A-1 is provided at a position which is more separated from the lower end plate first bolt hole 137A-1 than the lower end plate second circular hole 136A-2. In other words, the lower end plate second circular hole 136A-2 is provided to be closer to the lower end plate first bolt hole 137A-1 than the lower end plate first circular hole 136A-1.

The diameters of the lower end plate first circular hole 136A-1 and the lower end plate second circular hole 136A-2 have the maximum size that the lower plate first and second circular holes do not interfere with other mechanical elements of the lower end plate 160S. The total sectional area of the lower end plate first circular hole 136A-1 and the lower end plate second circular hole 136A-2, is S1.

At a circumferential edge of an opening portion of the lower discharge hole 190S, an annular lower valve seat 191S which is elevated with respect to a bottom portion of the lower discharge chamber concave portion 163S is formed, and the lower valve seat 191S abuts against the front portion of the lower discharge valve 200S. When the refrigerant is discharged from the lower discharge hole 190S, the lower discharge valve 200S is lifted only by a predetermined opening degree with respect to the lower valve seat 191S not to reach the resistance of the discharge flow.

In addition, as illustrated in FIG. 5, in the lower cylinder 121S, the lower cylinder first circular hole 136B-1 and the lower cylinder second circular hole 136B-2 are provided to be adjacent to each other within a second fan-shaped range on a plane of the lower cylinder 121S which is divided by a straight line that links a center O2 of the lower cylinder 121S through which the X-X shaft passes and the center of a lower cylinder first bolt hole 137B-1, and a straight line that links the center O2 and the center line of the lower vane groove 128S. The lower cylinder first circular hole 136B-1 is provided at a position which is more separated from the lower cylinder first bolt hole 137B-1 than the lower cylinder second circular hole 136B-2. In other words, the lower cylinder second circular hole 136B-2 is provided to be closer to the lower cylinder first bolt hole 137B-1 than the lower cylinder first circular hole 136B-1.

The diameters of the lower cylinder first circular hole 136B-1 and the lower cylinder second circular hole 136B-2 have the maximum size that the lower cylinder first and second circular holes do not interfere with other mechanical elements, for example, the lower vane groove 128S, of the lower cylinder 121S.

Here, the total sectional area of the lower cylinder first circular hole 136B-1 and the lower cylinder second circular hole 136B-2, is S2. In addition, the total sectional area of the area in which each of the sections of the lower cylinder first circular hole 136B-1 and the lower end plate first circular hole 136A-1 overlaps each other in the X-X shaft direction, and the area in which each of the sections of the lower cylinder second circular hole 136B-2 and the lower end plate second circular hole 136A-2 overlaps each other in the X-X shaft direction, is S2'. S2 and S2' have a size relationship of S1≥S2=S2' between the S2 and S2' and the above-described S1.

In addition, the relationship of "S2=S2'" indicates that, at a communication part (boundary) between the lower end plate first circular hole 136A-1 and the lower end plate second circular hole 136A-2 and at a communication part (boundary) between the lower cylinder first circular hole 136B-1 and the lower cylinder second circular hole 136B-2, the entire region of the section of the lower cylinder first circular hole 136B-1 overlaps the section of the lower end plate first circular hole 136A-1, and the entire region of the section of the lower cylinder second circular hole 136B-2 overlaps the section of the lower end plate second circular hole 136A-2. In other words, as illustrated in FIG. 5, when illustrating the region in which the lower end plate first circular hole 136A-1 and the lower cylinder first circular hole 136B-1 overlap each other and the region in which the lower end plate second circular hole 136A-2 and the lower cylinder second circular hole 136B-2 overlap each other by hatching, the entire region of the lower cylinder first circular hole 136B-1 and the lower cylinder second circular hole 136B-2 is a hatching region.

In addition, as illustrated in FIG. 6, on the intermediate partition plate 140, a connection hole 142*a* and an injection hole 142*b* to which an injection pipe 142 is fitted are provided within a third fan-shaped range on the intermediate partition plate first bolt hole 137C-1 side which is divided by a center line C (which corresponds to the positions of the lower vane groove 128S and the upper vane groove 128T) that equally divides the fan shape on the plane of the intermediate partition plate 140 which is divided by the straight line that links the center O3 of the intermediate partition plate 140 through which the X-X shaft passes and the center of the intermediate partition plate first bolt hole 137C-1, and by the straight line that links the center O3 and the center of the intermediate partition plate fifth bolt hole 137C-5.

For the purpose of improving the compression efficiency of the refrigerant, in order to cool the lower compression chamber 133S and the upper compression chamber 133T in the middle of compression, the liquid refrigerant (injection liquid) injected from the injection pipe 142 is injected to the lower compression chamber 133S and the upper compression chamber 133T from the injection hole 142*b* via the connection hole 142*a* (this is called injection). For example, in the connection hole 142*a* and the injection hole 142*b*, the center of the injection hole 142*b* is provided to be oriented toward the side opposite to the connection position between the compressor housing 10 and the upper inlet pipe 105 and the lower inlet pipe 104 from the center line C, and to be within a fan-shaped range of which a center angle θ is equal to or less than a predetermined angle, for example, 40°, around the X-X shaft which is the rotation center of the rotation shaft 15.

In addition, as illustrated in FIG. 6, on the intermediate partition plate 140, the intermediate partition plate first circular hole 136C-1 and the intermediate partition plate second circular hole 136C-2 are provided such that the connection hole 142*a* is positioned therebetween within the third fan-shaped range. The intermediate partition plate first circular hole 136C-1 is provided at a position which is more separated from the intermediate partition plate first bolt hole 137C-1 than the intermediate partition plate second circular hole 136C-2. In other words, the intermediate partition plate second circular hole 136C-2 is provided to be closer to the intermediate partition plate first bolt hole 137C-1 than the intermediate partition plate first circular hole 136C-1.

The diameters of the intermediate partition plate first circular hole 136C-1 and the intermediate partition plate second circular hole 136C-2 have the maximum size that the intermediate partition plate first and second circular holes do not interfere with other mechanical elements, for example, the connection hole 142*a* and the injection hole 142*b*, of the intermediate partition plate 140. However, the diameter of the intermediate partition plate first circular hole 136C-1 is restricted for avoiding the interference of the intermediate partition plate first circular hole with the connection hole 142*a* and the injection hole 142*b*, and the sizes of the diameters are naturally smaller than those of the lower end plate first circular hole 136A-1, the lower cylinder first circular hole 136B-1, the upper cylinder first circular hole 136D-1 which will be described later, and the upper end plate first circular hole 136E-1 which will be described later. Similarly, the diameter of the intermediate partition plate second circular hole 136C-2 is restricted for avoiding the interference of the intermediate partition plate second circular hole with the connection hole 142*a* and the injection hole 142*b*, and the sizes of the diameters are naturally smaller than those of the lower endplate second circular hole 136A-2, the lower cylinder second circular hole 136B-2, the upper cylinder second circular hole 136D-2 which will be described later, and the upper end plate second circular hole 136E-2 which will be described later. In addition, since the intermediate partition plate first circular hole 136C-1 is restricted for avoiding the interference with the connection hole 142*a* and the injection hole 142*b*, the intermediate partition plate first circular hole 136C-1 is provided in a state of being shifted with respect to the communication direction compared to the lower end plate first circular hole 136A-1, the lower cylinder first circular hole 136B-1, the upper cylinder first circular hole 136D-1, and the upper end plate first circular hole 136E-1. Similarly, since the intermediate partition plate second circular hole 136C-2 is restricted for avoiding the interference with the connection hole 142*a* and the injection hole 142*b*, the intermediate partition plate second circular hole 136C-2 is provided in a state of being shifted with respect to the communication direction compared to the lower end plate second circular hole 136A-2, the lower cylinder second circular hole 136B-2, the upper cylinder second circular hole 136D-2, and the upper end plate second circular hole 136E-2.

Here, the total sectional area of the intermediate partition plate first circular hole 136C-1 and the intermediate partition plate second circular hole 136C-2, is S3. In addition, the total sectional area of the area in which each of the sections of the intermediate partition plate first circular hole 136C-1 and the lower cylinder first circular hole 136B-1 overlaps each other in the X-X shaft direction, and the area in which each of the sections of the intermediate partition plate second circular hole 136C-2 and the lower cylinder second circular hole 136B-2 overlaps each other in the X-X shaft direction, is S3'. The total sectional areas S3 and S3' have the size relationship of "S2>S3≥S3'" between the total sectional areas S3 and S3' and the above-described S2.

In addition, the size relationship of "S3≥S3'" indicates that, at a communication part (boundary) between the lower cylinder first circular hole 136B-1 and the lower cylinder second circular hole 136B-2 and at a communication part (boundary) between the intermediate partition plate first circular hole 136C-1 and the intermediate partition plate second circular hole 136C-2, at least a part of the section of the intermediate partition plate first circular hole 136C-1 is shifted with respect to the section of the lower cylinder first circular hole 136B-1, or a part of the section of the intermediate partition plate second circular hole 136C-2 is shifted with respect to the section of the lower cylinder second circular hole 136B-2. In other words, as illustrated in FIG. 6, when illustrating the region in which the lower cylinder first circular hole 136B-1 and the intermediate partition plate first circular hole 136C-1 overlap each other and the region in which the lower cylinder second circular hole 136B-2 and the intermediate partition plate second circular hole 136C-2 overlap each other by hatching, for example, while the entire region of the intermediate partition plate second circular hole 136C-2 is a hatching region, a partial region of the intermediate partition plate first circular hole 136C-1 is not a hatching region.

Summarizing the above, the size relationship of S1, S2, S2', S3, and S3' is S1≥S2=S2'>S3≥S3' (hereinafter, referred to as a relation expression 1).

In addition, as illustrated in FIG. 7, in the upper cylinder 121T, the upper cylinder first circular hole 136D-1 and the upper cylinder second circular hole 136D-2 are provided to be adjacent to each other within a fourth fan-shaped range on a plane of the upper cylinder 121T which is divided by a straight line that links a center O4 of the upper cylinder 121T through which the X-X shaft passes and the center of the upper cylinder first bolt hole 137D-1, and a straight line that links the center O4 and the center line of the upper vane groove 128T. The upper cylinder second circular hole 136D-2 is provided within the fourth fan-shaped range, that is, at a position which is adjacent to the upper cylinder first circular hole 136D-1. The upper cylinder first circular hole 136D-1 is provided at a position which is more separated from the upper cylinder first bolt hole 137D-1 than the upper cylinder second circular hole 136D-2. In other words, the upper cylinder second circular hole 136D-2 is provided to be closer to the upper cylinder first bolt hole 137D-1 than the upper cylinder first circular hole 136D-1.

The diameters of the upper cylinder first circular hole 136D-1 and the upper cylinder second circular hole 136D-2 have the maximum size that the upper cylinder first and second circular holes do not interfere with other mechanical elements, for example, the upper vane groove 128T, of the upper cylinder 121T.

As illustrated in FIG. 2, the upper end plate cover chamber 180T is configured of the dome-shaped bulging portion of the upper end plate cover 170T, an upper discharge chamber concave portion 163T provided on the upper end plate 160T, and the upper discharge valve accommodation concave portion 164T. Although not being illustrated in detail, similar to the lower end plate cover chamber 180S, in the upper end plate cover chamber 180T, the upper discharge valve accommodation concave portion 164T extends in a direction intersecting with the diametrical line that links the center of the main bearing unit 161T and the center of the upper discharge hole 190T, that is, in a circumferential direction of the upper end plate 160T, linearly in a shape of a groove from the position of the upper discharge hole 190T. The upper discharge valve accommodation concave portion 164T is connected to the upper discharge chamber concave portion 163T. The upper discharge valve accommodation concave portion 164T is formed such that the width thereof is slightly greater than the widths of the upper discharge valve 200T and the upper discharge valve cap 201T, accommodates the upper discharge valve 200T and the upper discharge valve cap 201T therein, and positions the upper discharge valve 200T and the upper discharge valve cap 201T.

In addition, the upper discharge chamber concave portion 163T is formed at the depth which is the same as the depth of the lower discharge valve accommodation concave portion 164S to overlap the upper discharge hole 190T side of the upper discharge valve accommodation concave portion 164T. The upper discharge hole 190T side of the upper discharge valve accommodation concave portion 164T is accommodated in the upper discharge chamber concave portion 163T.

In addition, the upper discharge chamber concave portion 163T is formed within a fifth fan-shaped range on a plane of the upper end plate 160T which is divided by a straight line that links the center O5 of the upper end plate 160T through which the X-X shaft passes and the upper end plate first bolt hole 137E-1, and a straight line that links the center O5 and the upper end plate fifth bolt hole 137E-5 (refer to FIG. 8).

In addition, although not being illustrated in detail, similar to the lower end plate first circular hole 136A-1 on the lower end plate 160S, the upper end plate first circular hole 136E-1 is provided within the fifth fan-shaped range on the plane of the upper end plate 160T which is divided by the straight line that links the center O5 and the center of the upper end plate first bolt hole 137E-1 and the straight line that links the center O5 and the center of the upper end plate fifth bolt hole 137E-5, that is, at a position at which at least a part thereof overlaps the upper discharge chamber concave portion 163T and communicates with the upper discharge chamber concave portion 163T. In addition, although not being illustrated in detail, similar to the lower end plate second circular hole 136A-2 on the lower end plate 160S, the upper end plate second circular hole 136E-2 is provided within the fifth fan-shaped range, that is, at a position at which at least a part thereof overlaps the lower discharge chamber concave portion 163S, communicates with the upper discharge chamber concave portion 163T, and is adjacent to the upper end plate first circular hole 136E-1. The upper end plate first circular hole 136E-1 is provided at a position which is more separated from the upper end plate first bolt hole 137E-1 than the upper end plate second circular hole 136E-2. In other words, the upper end plate second circular hole 136E-2 is provided to be closer to the upper end plate first bolt hole 137E-1 than the upper end plate first circular hole 136E-1.

The diameters of the upper end plate first circular hole 136E-1 and the upper end plate second circular hole 136E-2 have the maximum size that the upper end plate first and second circular holes do not interfere with other mechanical elements of the upper end plate 160T.

Here, the total sectional area of the upper cylinder first circular hole 136D-1 and the upper cylinder second circular hole 136D-2, is S4. In addition, the total sectional area of the area in which each of the sections of the intermediate partition plate first circular hole 136C-1 and the upper cylinder first circular hole 136D-1 overlaps each other in the X-X shaft direction, and the area in which each of the sections of the intermediate partition plate second circular hole 136C-2 and the upper cylinder second circular hole 136D-2 overlaps each other in the X-X shaft direction, is S3'. The total sectional areas S4 and S3' have the size relationship of "S4>S3≥S3'"" between the total sectional areas S4 and S3' and the above-described total sectional area S3.

In addition, the size relationship of "S3≥S3'"" indicates that, at a communication part (boundary) between the intermediate partition plate first circular hole 136C-1 and the intermediate partition plate second circular hole 136C-2 and at a communication part (boundary) between the upper cylinder first circular hole 136D-1 and the upper cylinder second circular hole 136D-2, at least a part of the section of the intermediate partition plate first circular hole 136C-1 is shifted with respect to the section of the upper cylinder first circular hole 136D-1, or a part of the section of the intermediate partition plate second circular hole 136C-2 is shifted with respect to the section of the upper cylinder second circular hole 136D-2.

In addition, the total sectional area of the area in which each of the sections of the upper cylinder first circular hole 136D-1 and the upper end plate first circular hole 136E-1 overlaps each other in the X-X shaft direction, and the area in which each of the sections of the upper cylinder second circular hole 136D-2 and the upper end plate second circular hole 136E-2 overlaps each other in the X-X shaft direction, is S4'. In addition, the total sectional area of the upper end plate first circular hole 136E-1 and the upper end plate second circular hole 136E-2, is S5. The S4' and S5 have a size relationship of "S5≥S4=S4'" between the S4' and S5 and the above-described total sectional area S4.

In addition, the relationship of "S4=S4'" indicates that, at a communication part (boundary) between the upper cylinder first circular hole 136D-1 and the upper cylinder second circular hole 136D-2 and at a communication part (boundary) between the upper end plate first circular hole 136E-1 and the upper end plate second circular hole 136E-2, the entire region of the section of the upper cylinder first circular hole 136D-1 overlaps the section of the upper end plate first circular hole 136E-1, and the entire region of the section of the upper cylinder second circular hole 136D-2 overlaps the section of the upper end plate second circular hole 136E-2.

Summarizing the above, the size relationship of S3, S3', S4, and S5 is S5≥S4=S4'>S3≥S3' (hereinafter, referred to as a relation expression 2).

Figure 9:
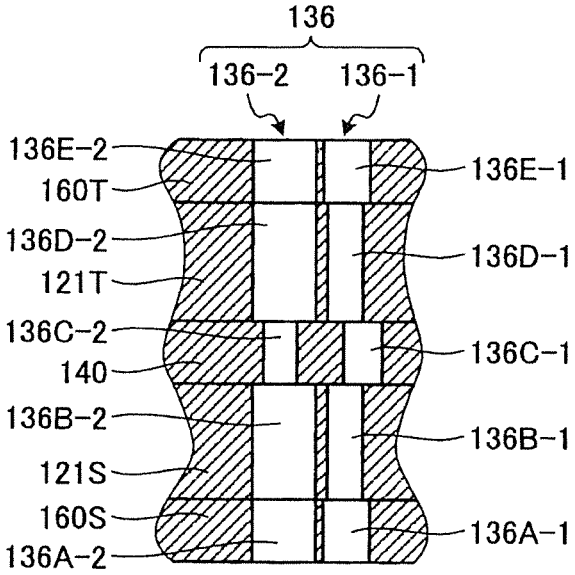
FIG. 9 is a longitudinal sectional view illustrating the vicinity of a refrigerant path hole of the rotary compressor of Example 1.

FIG. 9 is a longitudinal sectional view illustrating the vicinity of a refrigerant path hole of the rotary compressor of Example 1. FIG. 9 is, for example, a view when a section taken along line A-A' (refer to FIG. 4) of the refrigerant path hole 136 that satisfies the above-described (relation expression 1) and (relation expression 2) is viewed from the center O1 side (X-X shaft side).

As illustrated in FIG. 9, at the communication part (boundary) between the lower end plate first circular hole 136A-1 and the lower end plate second circular hole 136A-2 and at the communication part (boundary) between the lower cylinder first circular hole 136B-1 and the lower cylinder second circular hole 136B-2, the total sectional area of the refrigerant path hole 136 (the first refrigerant path hole 136-1 and the second refrigerant path hole 136-2) is smaller than that on the lower cylinder 121S side compared to the lower end plate 160S side.

In addition, as illustrated in FIG. 9, at the communication part (boundary) between the lower cylinder first circular hole 136B-1 and the lower cylinder second circular hole 136B-2 and at the communication part (boundary) between the intermediate partition plate first circular hole 136C-1 and the intermediate partition plate second circular hole 136C-2, the total sectional area of the refrigerant path hole 136 (the first refrigerant path hole 136-1 and the second refrigerant path hole 136-2) is smaller than that on the intermediate partition plate 140 side compared to the lower cylinder 121S side. Furthermore, the section of a part of the intermediate partition plate first circular hole 136C-1 does not overlap the section of the lower cylinder first circular hole 136B-1. In other words, in the first refrigerant path hole 136-1, at the part from the lower end plate 160S to the lower cylinder 121S, a bottleneck caused by the shift of the section is formed at the communication part (boundary).

The example illustrated in FIG. 9 is vertically symmetric in the X-X shaft direction regarding the intermediate partition plate 140 as a boundary, the communication part of the refrigerant path hole 136 between the intermediate partition plate 140 and the upper cylinder 121T is similar to the communication part of the refrigerant path hole 136 between the intermediate partition plate 140 and the lower cylinder 121S, and the communication part of the refrigerant path hole 136 between the upper cylinder 121T and the upper end plate 160T is similar to the communication part of the refrigerant path hole 136 between the lower cylinder 121S and the lower end plate 160S.

In addition, when each of the sectional areas in a case where the refrigerant path holes have the same diameter and communicate with the lower end plate, the lower cylinder, the intermediate partition plate, the upper cylinder, and the upper end plate is set to be "1" in the related art, in the refrigerant path hole 136 of Example 1, the total sectional areas S1 and S5 in which the lower endplate 160S and the upper endplate 160T communicate with each other are "2.7", the total sectional areas S2 and S4 in which the lower cylinder 121S and the upper cylinder 121T communicate with each other are "2.5", and the total sectional area S3 which communicates with the intermediate partition plate 140 is "1.8".

Figure 10:
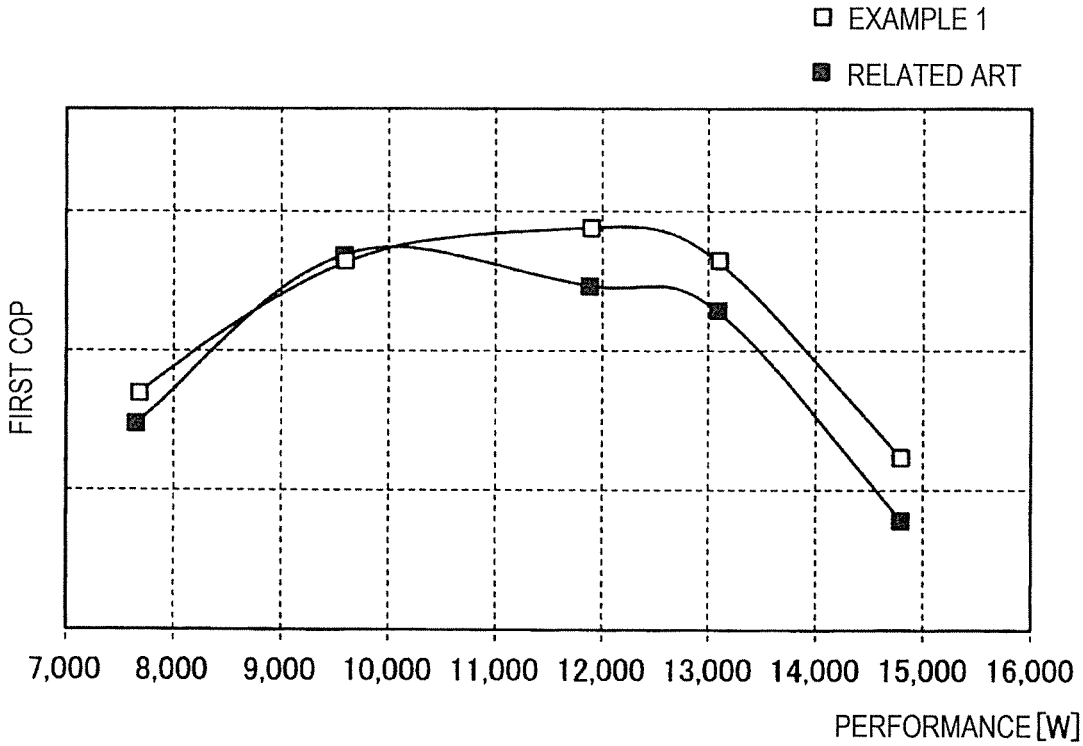
FIG. 10 is a view illustrating improvement of a first energy conversion COP of the rotary compressor of Example 1.

FIG. 10 is a view illustrating improvement of a first energy conversion COP of the rotary compressor of Example 1. FIG. 10 is a graph in which each first energy conversion coefficient of performance (COP) is compared to each other regarding an air conditioner in which the rotary compressor 1 of Example 1 is employed, and an air conditioner in which the rotary compressor of the related art is employed. In FIG. 10, the performance of the air conditioner [W] is expressed in the horizontal shaft, and the first energy conversion COP is expressed in the longitudinal shaft. As can be ascertained from FIG. 10, in the air conditioner in which Example 1 is employed, it is ascertained that the first energy conversion COP is improved. In other words, the compression efficiency of the rotary compressor 1 of Example 1 is improved.

Figure 11:
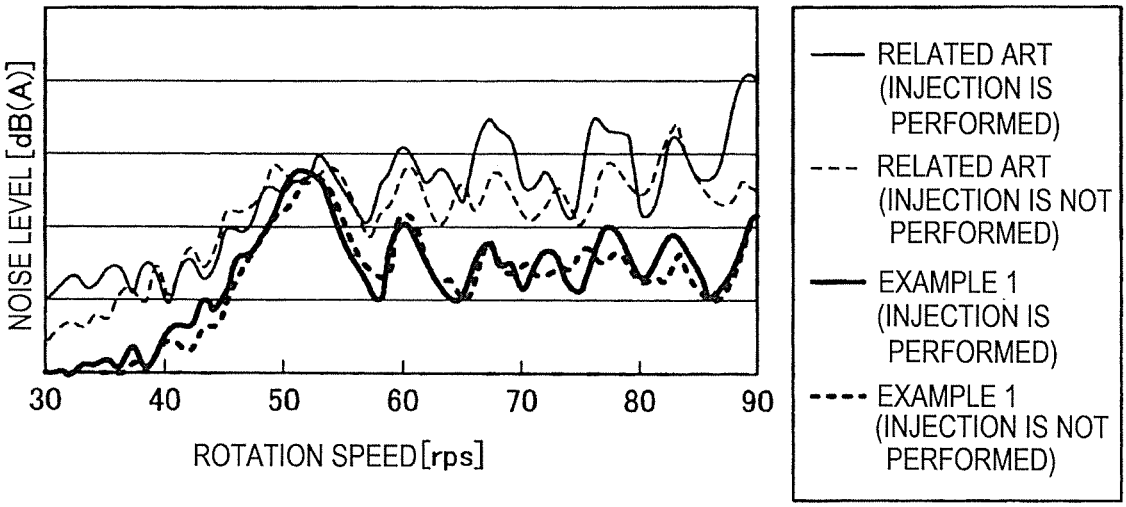
FIG. 11 is a view illustrating reduction of noise of the rotary compressor of Example 1.

FIG. 11 is a view illustrating reduction of noise of the rotary compressor of Example 1. FIG. 11 is a graph in which each of noise levels is compared to each other with respect to a case where the injection is performed and a case where the injection is not performed, regarding the air conditioner in which the rotary compressor 1 of Example 1 is employed and the air conditioner in which the rotary compressor of the related art is employed. As can be ascertained from FIG. 11, in the air conditioner in which the rotary compressor 1 of Example 1 is employed, with respect to both of the case where the injection is performed and the case where the injection is not performed, it is ascertained that the noise level deteriorates. In other words, in the air conditioner in which the rotary compressor 1 of Example 1 is employed, quietness is improved. In particular, in a case where the injection is performed, quietness is improved. In addition, since the quietness is improved, a pressure loss of the compressed refrigerant of the rotary compressor 1 deteriorates.

By the configuration of the rotary compressor 1 of the above-described Example 1, the overlapping part of each of the circular holes of the first refrigerant path hole 136-1 and the second refrigerant path hole 136-2 is sufficiently ensured at the communication part (boundary) of the refrigerant path hole 136 in each of the lower end plate 160S, the lower cylinder 121S, the intermediate partition plate 140, the upper cylinder 121T, and the upper end plate 160T, and thus, the flow channel resistance can be reduced at the communication part (boundary) of the refrigerant path hole 136 with respect to the refrigerant that flows through the first refrigerant path hole 136-1 and the second refrigerant path hole 136-2, and the compression efficiency of the rotary compressor 1 can be improved.

In addition, by the configuration of the rotary compressor 1 of the above-described Example 1, the flow channel resistance of the refrigerant that flows through the first refrigerant path hole 136-1 and the second refrigerant path hole 136-2 can be reduced, and the noise of the rotary compressor 1 can be reduced.

In addition, in a case where the connection hole 142*a* and the injection hole 142*b* for the injection for improving the compression efficiency are provided on the intermediate partition plate 140, the first refrigerant path hole 136-1 and the second refrigerant path hole 136-2 on the intermediate partition plate 140 are provided in a state where the diameters are small and the holes are shifted, compared to the first refrigerant path hole 136-1 and the second refrigerant path hole 136-2 on the lower end plate 160S, the lower cylinder 121S, the upper cylinder 121T, and the upper end plate 160T. However, by the configuration of the rotary compressor 1 of the above-described Example 1, the diameters of the first refrigerant path hole 136-1 and the second refrigerant path hole 136-2 in the lower end plate 160S, the lower cylinder 121S, the intermediate partition plate 140, the upper cylinder 121T, and the upper end plate 160T have the maximum size that the first and second refrigerant path holes do not interfere with other mechanical elements in each thereof. Accordingly, on the intermediate partition plate 140, in a state where the first refrigerant path hole 136-1 and the second refrigerant path hole 136-2 have small diameters and shifted holes compared to the lower end plate 160S, the lower cylinder 121S, the upper cylinder 121T, and the upper end plate 160T, even when the refrigerant flow rate is increased by the injection, the flow channel resistance of the refrigerant that flows through the first refrigerant path hole 136-1 and the second refrigerant path hole 136-2 is reduced, and thus, it is possible to improve the compression efficiency of the rotary compressor 1, and to reduce the noise.

In addition, by the configuration of the rotary compressor 1 of the above-described Example 1, the total sectional area S1 of the lower end plate first circular hole 136A-1 and the lower end plate second circular hole 136A-2 on the lower end plate 160S is greater than the total sectional area S2 of the lower cylinder first circular hole 136B-1 and the lower cylinder second circular hole 136B-2 in the lower cylinder 121S. Accordingly, the resistance when the refrigerant discharged to the lower end plate cover chamber 180S (lower muffler) from the lower discharge hole 190S provided on the lower end plate 160S flows into the first refrigerant path hole 136-1 and the second refrigerant path hole 136-2, is reduced.

In addition, in the above-described Example 1, two refrigerant path holes 136, such as the first refrigerant path hole 136-1 and the second refrigerant path hole 136-2, are provided, but one or three or more holes may be provided.

In addition, in the above-described Example 1, two refrigerant path holes 136, such as the first refrigerant path hole 136-1 and the second refrigerant path hole 136-2, are provided to be adjacent to each other, but two first refrigerant path hole 136-1 and the second refrigerant path hole 136-2 may be provided to be connected to each other. In other words, the lower end plate first circular hole 136A-1 and the lower end plate second circular hole 136A-2 may be provided to be connected to each other. Each of the lower cylinder first circular hole 136B-1, the lower cylinder second circular hole 136B-2, the intermediate partition plate first circular hole 136C-1, the intermediate partition plate second circular hole 136C-2, the upper cylinder first circular hole 136D-1, the upper cylinder second circular hole 136D-2, the upper end plate first circular hole 136E-1, and the upper end plate second circular hole 136E-2, is also similar.

In addition, in the above-described Example 1, similar to the lower end plate first circular hole 136A-1, the lower cylinder first circular hole 136B-1, the intermediate partition plate first circular hole 136C-1, the upper cylinder first circular hole 136D-1, the upper end plate first circular hole 136E-1, the lower end plate second circular hole 136A-2, the lower cylinder second circular hole 136B-2, the intermediate partition plate second circular hole 136C-2, the upper cylinder second circular hole 136D-2, and the upper end plate second circular hole 136E-2, the holes that form the first refrigerant path hole 136-1 and the second refrigerant path hole 136-2 are circular holes. However, the holes which form the first refrigerant path hole 136-1 and the second refrigerant path hole 136-2 are not limited to the circular holes, and may have any shape, such as an elliptical shape, as long as the hole has a sectional shape that reduces the flow channel resistance of the refrigerant that flows through the refrigerant path hole 136. In a case of a hole other than the circular holes, the "diameter" is the "maximum diameter".

In addition, in the above-described Example 1, the lower end plate first circular hole 136A-1 and the upper end plate first circular hole 136E-1 may have the same diameter, the lower end plate second circular hole 136A-2 and the upper end plate second circular hole 136E-2 may have the same diameter, the lower cylinder first circular hole 136B-1 and the upper cylinder first circular hole 136D-1 may have the same diameter, and the lower cylinder second circular hole 136B-2 and the upper cylinder second circular hole 136D-2 may have the same diameter. Accordingly, a drill blade or the like can be used in common, the number of processing can be reduced, and the processing costs can be reduced.

In addition, in the above-described Example 1, on the lower end plate 160S, the lower end plate first circular hole 136A-1 may have the same diameter as that of any other bolt holes provided on the lower end plate 160S. Similarly, on the lower end plate 160S, the lower end plate second circular hole 136A-2 which forms the second refrigerant path hole 136-2 may have the same diameter as that of any other bolt holes provided on the lower end plate 160S. The lower cylinder 121S, the intermediate partition plate 140, the upper cylinder 121T, and the upper end plate 160T are also similar.

In other words, on the lower end plate 160S, the lower end plate first circular hole 136A-1 and/or the lower end plate second circular hole 136A-2 may be formed by using the drill blade or the like which is common to any of the lower discharge hole 190S, the lower end plate first bolt holes 137A-1 to the lower end plate fifth bolt hole 137A-5, the positioning bolt hole when fixing the lower end plate 160S in the compressing unit 12, and a rivet hole for fixing the lower rivet 202S to the lower end plate 160S. On the lower end plate 160S, the lower discharge hole 190S, the lower end plate first bolt hole 137A-1 to the lower end plate fifth bolt hole 137A-5, the positioning bolt hole when fixing the lower end plate 160S in the compressing unit 12, and the rivet hole for fixing the lower rivet 202S to the lower end plate 160S, are an example of the hole provided in addition to the refrigerant path hole 136.

In addition, similarly, in the lower cylinder 121S, the lower cylinder first circular hole 136B-1 and the lower cylinder second circular hole 136B-2 may be formed by using the drill blade or the like which is common to any of the lower cylinder first bolt hole 137B-1 to the lower cylinder fifth bolt hole 137B-5, the positioning bolt hole when fixing the lower cylinder 121S in the compressing unit 12, and a rivet escape hole for accommodating a head portion of the lower rivet 202S of the lower endplate 160S. In the lower cylinder 121S, the lower cylinder first bolt hole 137B-1 to the lower cylinder fifth bolt hole 137B-5, the positioning bolt hole when fixing the lower cylinder 121S in the compressing unit 12, and the rivet escape hole for accommodating the head portion of the lower rivet 202S of the lower end plate 160S, are an example of the hole provided in addition to the refrigerant path hole 136.

In addition, similarly, on the intermediate partition plate 140, the intermediate partition plate first circular hole 136C-1 and/or the intermediate partition plate second circular hole 136C-2 may be formed by using the drill blade or the like which is common to any of the intermediate partition plate first bolt hole 137C-1 to the intermediate partition plate fifth bolt hole 137C-5, and the positioning bolt hole when fixing the intermediate partition plate 140 in the compressing unit 12. On the intermediate partition plate 140, the intermediate partition plate first bolt hole 137C-1 to the intermediate partition plate fifth bolt hole 137C-5, the positioning bolt hole when fixing the intermediate partition plate 140 in the compressing unit 12, or the like, are an example of the hole provided in addition to the refrigerant path hole 136.

In addition, similarly, in the upper cylinder 121T, the upper cylinder first circular hole 136D-1 and/or the upper cylinder second circular hole 136D-2 may be formed by using the drill blade or the like which is common to any of the upper cylinder first bolt hole 137D-1 to the upper cylinder fifth bolt hole 137D-5, the positioning bolt hole when fixing the lower end plate 160S in the compressing unit 12, and the rivet escape hole for accommodating the head portion of the upper rivet 202T of the upper end plate 160T. In the upper cylinder 121T, the upper cylinder first bolt hole 137D-1 to the upper cylinder fifth bolt hole 137D-5, the positioning bolt hole when fixing the lower end plate 160S in the compressing unit 12, the rivet escape hole for accommodating the head portion of the upper rivet 202T of the upper end plate 160T, or the like, are an example of the hole provided in addition to the refrigerant path hole 136.

In addition, similarly, on the upper end plate 160T, the upper end plate first circular hole 136E-1 and/or the upper end plate second circular hole 136E-2 may be formed by using the drill blade or the like which is common to any of the upper discharge hole 190T, the upper end plate first bolt hole 137E-1 to the upper end plate fifth bolt hole 137E-5, the positioning bolt hole when fixing the upper end plate 160T in the compressing unit 12, and the rivet hole for fixing the upper rivet 202T to the upper end plate 160T. Accordingly, the number of processing can be reduced, and the processing costs can be reduced. On the upper end plate 160T, the upper discharge hole 190T, the upper end plate first bolt hole 137E-1 to the upper end plate fifth bolt hole 137E-5, the positioning bolt hole when fixing the upper end plate 160T in the compressing unit 12, the rivet hole for fixing the upper rivet 202T to the upper end plate 160T, or the like, are an example of the hole provided in addition to the refrigerant path hole 136.

In addition, in the above-described Example 1, the size relationship of the total sectional areas S1 and S2 is S1≥S2, but the invention is not limited thereto. Similarly, in the above-described Example 1, the size relationship of the total sectional areas S4 and S5 is S5≥S4, but the invention is not limited thereto. For example, even when the diameter of the refrigerant path hole 136 is the minimum diameter on the lower end plate 160S and the upper end plate 160T, is the maximum diameter in the lower cylinder chamber 130S and the upper cylinder chamber 130T, and is the medium diameter on the intermediate partition plate 140, the diameter of the refrigerant path hole 136 increases in the lower cylinder chamber 130S and the upper cylinder chamber 130T in the middle, and thus, it is possible to reduce the pressure loss of the rotary compressor 1.

EXAMPLE 2

Hereinafter, Example 2 according to the invention will be described. In addition, the same configurations are given the same reference numerals, and description of the configurations which has been already described will be omitted.

Figure 12:
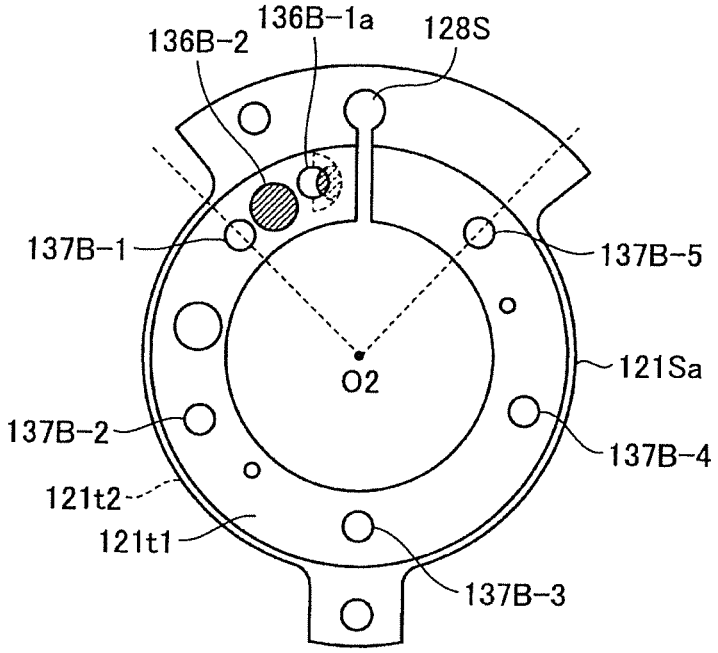
FIG. 12 is a bottom view illustrating a lower cylinder of a rotary compressor of Example 2.
Figure 13:
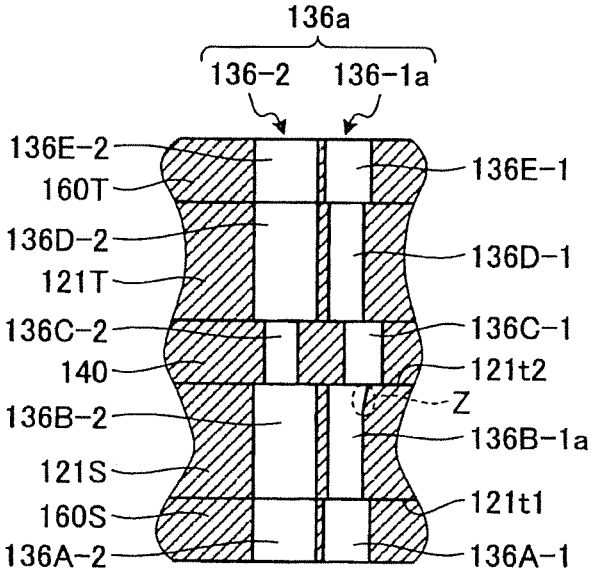
FIG. 13 is a longitudinal sectional view illustrating the vicinity of a refrigerant path hole of the rotary compressor of Example 2.

FIG. 12 is a bottom view illustrating a lower cylinder of a rotary compressor of Example 2. FIG. 13 is a longitudinal sectional view illustrating the vicinity of a refrigerant path hole of the rotary compressor of Example 2. As illustrated in FIGS. 12 and 13, in a lower cylinder 121Sa of a rotary compressor 1*a* (refer to FIG. 1) of Example 2, in a lower cylinder first circular hole 136B-1*a* which forms a first refrigerant path hole 136-1*a* of a refrigerant path hole 136*a*, compared to the lower cylinder first circular hole 136B-1 of Example 1, a spot facing or a cutout is provided on an end surface 121*t*2 on the intermediate partition plate 140 side which is a surface opposite to an end surface 121*t*1 on the lower end plate 160S side (refer to a frame-surrounded part Z of FIG. 13), and an area of a part at which the lower cylinder first circular hole 136B-1*a* of the first refrigerant path hole 136-1*a* and the intermediate partition plate first circular hole 136C-1 overlap each other in the lower cylinder 121Sa and the intermediate partition plate 140, expands (refer to the hatching part of the lower cylinder first circular hole 136B-1*a* of FIG. 12).

By the configuration of the rotary compressor 1*a* of the above-described Example 2, in the lower cylinder first circular hole 136B-1*a*, as the spot facing or the cutout is provided on the end surface 121*t*2 on the intermediate partition plate 140 side, the area in which the section of the first refrigerant path hole 136-1*a* in the lower cylinder 121Sa and the section of the first refrigerant path hole 136-1*a* on the intermediate partition plate 140 overlap each other in the X-X shaft direction expands, and accordingly, it is possible to increase the above-described total sectional area S3', to reduce the flow channel resistance of the refrigerant that flows through the first refrigerant path hole 136-1*a*, and to improve the compression efficiency of the rotary compressor 1*a*.

In addition, similar spot facings or cutouts may be provided on the end surface on the lower endplate 160S side or the end surface on the lower cylinder 121Sa side at the communication part between the lower end plate 160S and the lower cylinder 121Sa in the first refrigerant path hole 136-1*a* or the second refrigerant path hole 136-2. In addition, the spot facing or the cutout may be provided on the end surface on the intermediate partition plate 140 side at the communication part between the lower cylinder 121Sa and the intermediate partition plate 140. In addition, the spot facing or the cutout may be provided on the end surface on the intermediate partition plate 140 side or the end surface on the upper cylinder 121T side at the communication part between the intermediate partition plate 140 and the upper cylinder 121T. Otherwise, the spot facing or the cutout may be provided on the end surface on the upper cylinder 121T side or the end surface on the upper end plate 160T side at the communication part between the upper cylinder 121T and the upper end plate 160T.

In addition, in the above-described example, the total area of cross sections of the lower end plate first circular hole 136A-1 and the lower end plate second circular hole 136A-2 has the maximum size that the lower end plate first circular hole 136A-1 and the lower end plate second circular hole 136A-2 do not interfere with other mechanical elements on the lower end plate 160S, but the total area is not limited to the maximum size. The total areas of the lower cylinder first circular hole 136B-1 and the lower cylinder second circular hole 136B-2, the intermediate partition plate first circular hole 136C-1 and the intermediate partition plate second circular hole 136C-2, the upper cylinder first circular hole 136D-land the upper cylinder second circular hole 136D-2, and the upper end plate first circular hole 136E-1 and the upper end plate second circular hole 136E-2, are also similar thereto.

Above, the examples are described, but the examples are not limited by the above-described contents. In addition, in the above-described configuration elements, elements which can be easily assumed by those skilled in the art, elements which are substantially the same, and elements which are in a so-called equivalent range, are included. Furthermore, the above-described configuration elements can be appropriately combined with each other. Furthermore, at least one of various omissions, replacements, and changes of the configuration elements can be performed within the range that does not depart from the scope of the example.

What is claimed is:

1. A rotary compressor which includes a sealed vertically-placed cylindrical compressor housing which is provided with a discharge pipe that discharges a refrigerant in an upper portion thereof, and which is provided with an upper inlet pipe and a lower inlet pipe that suction the refrigerant in a lower portion of a side surface thereof, an accumulator which is fixed to a side portion of the compressor housing and is connected to the upper inlet pipe and the lower inlet pipe, a motor which is disposed in the compressor housing, and a compressing unit which is disposed below the motor in the compressor housing, is driven by the motor, suctions and compresses the refrigerant from the accumulator via the upper inlet pipe and the lower inlet pipe, and discharges the refrigerant from the discharge pipe, and in which the compressing unit includes an annular upper cylinder and an annular lower cylinder, an upper end plate which blocks an upper side of the upper cylinder and a lower end plate which blocks a lower side of the lower cylinder, an intermediate partition plate which is disposed between the upper cylinder and the lower cylinder and blocks the lower side of the upper cylinder and the upper side of the lower cylinder, a rotation shaft which is supported by a main bearing unit provided on the upper end plate and a sub-bearing unit provided on the lower end plate, and is rotated by the motor, an upper eccentric portion and a lower eccentric portion which are provided with a phase difference from each other in a rotation shaft, an upper piston which is fitted to the upper eccentric portion, revolves along an inner circumferential surface of the upper cylinder, and forms an upper cylinder chamber in the upper cylinder, a lower piston which is fitted to the lower eccentric portion, revolves along an inner circumferential surface of the lower cylinder, and forms a lower cylinder chamber in the lower cylinder, an upper vane which protrudes from an upper vane groove provided in the upper cylinder in the upper cylinder chamber, abuts against the upper piston, and divides the upper cylinder chamber into an upper inlet chamber and an upper compression chamber, a lower vane which protrudes from a lower vane groove provided in the lower cylinder in the lower cylinder chamber, abuts against the lower piston, and divides the lower cylinder chamber into a lower inlet chamber and a lower compression chamber, an upper end plate cover which covers the upper end plate, forms an upper end plate cover chamber between the upper end plate and the upper end plate cover, and has an upper end plate cover discharge hole that allows the upper end plate cover chamber and the inside of the compressor housing to communicate with each other, a lower end plate cover which covers the lower end plate and forms a lower end plate cover chamber between the lower end plate and the lower end plate cover, an upper discharge hole which is provided on the upper end plate and allows the upper compression chamber and an upper end plate cover chamber to communicate with each other, a lower discharge hole which is provided on the lower end plate and allows the lower compression chamber and a lower end plate cover chamber to communicate with each other, and a refrigerant path hole which penetrates the lower end plate, the lower cylinder, the intermediate partition plate, the upper cylinder, and the upper end plate, and communicates with the lower end plate cover chamber and the upper end plate cover chamber, the compressor comprising:

an upper discharge valve which opens and closes the upper discharge hole;

a lower discharge valve which opens and closes the lower discharge hole;

an upper discharge valve accommodation concave portion which is provided on the upper end plate and extends in a shape of a groove from a position of the upper discharge hole; and a lower discharge valve accommodation concave portion which is provided on the lower end plate and extends in a shape of a groove from a position of the lower discharge hole, wherein the lower end plate cover is formed in a shape of a flat plate, wherein a lower discharge chamber concave portion is formed on the lower end plate to overlap the lower discharge hole side of the lower discharge valve accommodation concave portion, wherein the lower end plate cover chamber is configured of the lower discharge chamber concave portion and the lower discharge valve accommodation concave portion, wherein the lower discharge chamber concave portion is formed within a fan-shaped range between straight lines that link the center of a first insertion hole and the center of a second insertion hole which are adjacent to each other among a plurality of insertion holes into which a fastening member that fastens the lower end plate cover, the lower end plate, the lower cylinder, the intermediate partition plate, the upper cylinder, the upper end plate, and the upper end plate cover is inserted and which are provided on a circumference of a concentric circle around the rotation shaft to penetrate the lower end plate, the lower cylinder, the intermediate partition plate, the upper cylinder, and the upper end plate, and the center of the sub-bearing unit, wherein the refrigerant path hole communicates with the lower discharge chamber concave portion while at least a part thereof overlaps the lower discharge chamber concave portion, and is positioned between the lower vane groove and the first insertion hole in the lower cylinder, and between the upper vane groove and the first insertion hole in the upper cylinder, and wherein S1>S3, S2>S3, and S2'>S3' are satisfied when a sectional area of the refrigerant path hole on the lower end plate is S1, a sectional area of the refrigerant path hole in the lower cylinder is S2, a sectional area of the refrigerant path hole on the intermediate partition plate is S3, an area in which a section of the refrigerant path hole on the lower end plate and a section of the refrigerant path hole in the lower cylinder overlap each other is S2', and an area in which a section of the refrigerant path hole in the lower cylinder and a section of the refrigerant path hole on the intermediate partition plate overlap each other is S3'.

2. The rotary compressor according to claim 1, wherein the sectional area of the refrigerant path hole on the lower end plate Si and the sectional area of the refrigerant path hole in the lower cylinder S2 satisfy S1≥S2.

3. The rotary compressor according to claim 1, wherein the compressing unit further includes a connection hole that carries a liquid refrigerant from an injection pipe, and an injection hole which injects the liquid refrigerant that has gone through the connection hole into the compression chamber, on the intermediate partition plate, and wherein the center of the injection hole is provided within a fan-shaped range that is defined by 40 degrees from a center line of either of the upper or lower vane grooves in a circumferential direction of the rotation shaft.

4. The rotary compressor according to claim 1, wherein the refrigerant path hole on the lower endplate and the refrigerant path hole on the upper end plate have the same diameter, and the refrigerant path hole in the lower cylinder and the refrigerant path hole in the upper cylinder have the same diameter.

5. The rotary compressor according to claim 1, wherein the plurality of insertion holes have the same diameter of the refrigerant path hole in at least one of the lower end plate, the lower cylinder, the intermediate partition plate, the upper cylinder, and the upper end plate.

6. The rotary compressor according to claim 1, wherein a spot facing or a cutout is provided on an end surface of the refrigerant path hole in at least one of: the lower end plate, the lower cylinder, the intermediate partition plate, the upper cylinder, and the upper end plate.

7. The rotary compressor according to claim 1, wherein relational expressions, S5>S3, S4>S3 and S4'>S3", are satisfied when a sectional area of the refrigerant path hole in the upper cylinder is S4, a sectional area of the refrigerant path hole on the upper end plate is S5, an area in which a section of the refrigerant path hole on the upper end plate and a section of the refrigerant path hole in the upper cylinder overlap each other is S4', and an area in which a section of the refrigerant path hole in the upper cylinder and a section of the refrigerant path hole on the intermediate partition plate overlap each other is S3".

8. The rotary compressor according to claim 7, wherein the sectional area of the refrigerant path hole in the upper cylinder S4 and the sectional area of the refrigerant path hole on the upper end plate S5 satisfy S5≥S4.

* * * * *